US006739530B1

(12) United States Patent
Shilton et al.

(10) Patent No.: US 6,739,530 B1
(45) Date of Patent: May 25, 2004

(54) SURFACE STATIC REDUCTION DEVICE

(75) Inventors: Mark Golder Shilton, Aston Clinton (GB); Peter Miles, Little Chalfont (GB)

(73) Assignee: AEA Technology PLC, Oxfordshire (GB)

( * ) Notice: Subject to any disclaimer, the term of this patent is extended or adjusted under 35 U.S.C. 154(b) by 0 days.

(21) Appl. No.: 09/308,199

(22) PCT Filed: Nov. 14, 1997

(86) PCT No.: PCT/GB97/03147

§ 371 (c)(1),
(2), (4) Date: Oct. 18, 1999

(87) PCT Pub. No.: WO98/23136

PCT Pub. Date: May 28, 1998

(30) Foreign Application Priority Data

Nov. 15, 1996 (EP) ..... 96308302

(51) Int. Cl.[7] ..... B05B 1/14

(52) U.S. Cl. ..... 239/590.3; 239/590.5; 239/690

(58) Field of Search ..... 239/590, 590.3, 239/591, 590.5, 690

(56) References Cited

U.S. PATENT DOCUMENTS

| | | | | |
|---|---|---|---|---|
| 3,784,876 A | | 1/1974 | De Gaston | 317/2 R |
| 3,899,137 A | * | 8/1975 | Shenker | 239/545 |
| 4,154,405 A | * | 5/1979 | Stenstrom | 239/590.3 |
| 4,339,782 A | | 7/1982 | Yu et al. | 361/229 |
| 4,438,479 A | | 3/1984 | Schwartz et al. | 361/213 |
| 4,665,462 A | | 5/1987 | Blitshteyn et al. | 361/213 |
| 4,686,370 A | | 8/1987 | Blach | 250/423 R |
| 5,095,400 A | | 3/1992 | Saito | 361/220 |
| 5,317,159 A | * | 5/1994 | Fukushima et al. | |
| 5,388,769 A | | 2/1995 | Rodrigo et al. | 239/690 |
| 5,554,846 A | * | 9/1996 | Regiec et al. | |
| 5,749,529 A | * | 5/1998 | Kazama et al. | 239/690 |
| 5,792,057 A | * | 8/1998 | Rubsamen et al. | 600/431 |

FOREIGN PATENT DOCUMENTS

| | | |
|---|---|---|
| DE | 1 297 782 | 6/1969 |
| FR | 1109509 | 1/1956 |
| NL | 272300 | 8/1964 |

* cited by examiner

*Primary Examiner*—Christopher Kim
(74) *Attorney, Agent, or Firm*—Marshall, Gerstein & Borun LLP

(57) ABSTRACT

A radioactive static eliminator gun has a cartridge (7) connected to a high pressure air supply (8). Within the cartridge (7) a radioactive source (6) which generates alpha particles is located coaxially along the central longituidinal axis. The alpha particles collide with the high pressure air stream passing through the cartridge thereby generating ions. With this arrangement the ion concentration is greatest at the core of the air stream which ensures that the greatest number of ions is delivered to the surface requiring static elimination. The radioactive static eliminator gun provides improved efficiency in removing static an is particularly suited to use in paint spraying of metal surfaces where the electrostatic forces at the surface of the metal may not be strong enough to attract ions in the air stream emerging from the gun.

12 Claims, 11 Drawing Sheets

SURFACE STATIC REDUCTION DEVICE

The present invention relates to a surface static reduction device for use, for example, in reducing and preferably eliminating static electricity from surfaces to be sprayed with paint. In particular, the present invention provides an improved radioactive gun for the reduction of static.

There are many ways of eliminating static electricity. These may involve the use of high voltage devices which use a corona discharge to generate ionized air, there are so-called passive devices which consist of unpowered arrays of sharp points, there are electrically powered X-ray tube devices which ionize air by emitting low energy X-rays and there are radioactive devices which are generally described as bars, guns or cartridges which use radioactive sources to ionize, air. Devices can be used in combination with each other and in conjunction with, blowers, fans, compressed air lines and the like which guide the ionized air to where it is needed. All the methods seek to produce and direct as many ions as possible to the charged work surface. There they can neutralize unwanted electrostatic charge which may have built up.

Figure 1:
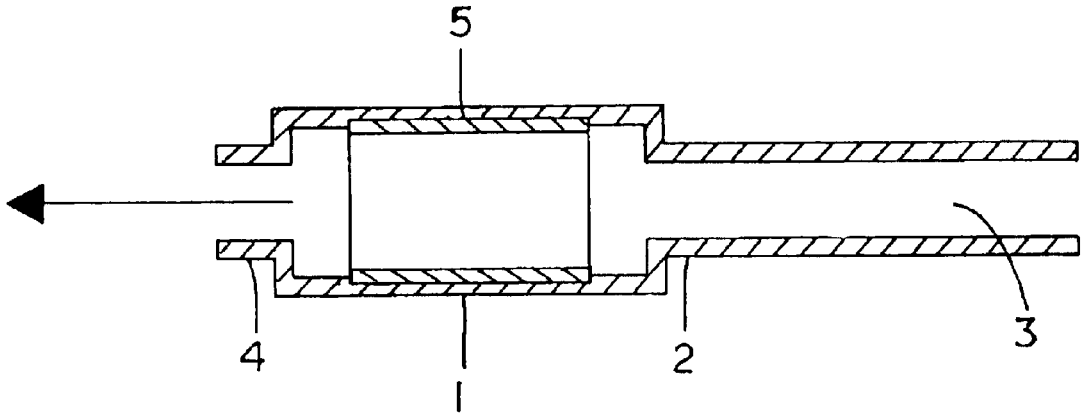

The basic design concept and operating principle for radioactive guns and ionizing cartridges is described below by reference to FIG. 1. Devices work by passing air from a high pressure feed line 3 at a high velocity into an input nozzle end 2 of a hollow cylindrical cartridge 1 which is open at the other end with an outlet nozzle 4. Inside the cartridge 1 is placed a source of ionizing radiation 5 which is commonly a metal foil containing the radioisotope polonium-210 which emits alpha particles. This causes the air flowing through the cartridge to become ionized. The air exits the cartridge through the outlet nozzle 4 and is then directed towards a charged surface by the operator of the device. Ions in the air stream are blown onto the surface and/or are drawn towards it by an electrostatic field associated with the charge on the surface and they cause the charge on the surface to be neutralized. Static radioactive guns and ionizing cartridges such as the one represented in FIG. 1 are well known in the industry and such devices using this operating principle have been available for many years.

The main field of application is in manufacturing industry where it is important for certain articles to be kept clean and free from dust and charge during their assembly. An important application is in the paint spraying industry. In this application it is well known that both dust and charge on a surface give rise to a poor quality paint finish and there can be a significant cost associated with rework. The radioactive ionizing gun provides a means of improving the quality of the surface finish by eliminating both dust and charge simultaneously prior to painting. High voltage corona discharge devices are potential fire hazards in this application and they are generally not used by industries which perform paint spraying on safety grounds.

The efficiency of existing radioactive guns and cartridges can be adversely affected where local conditions vary and also due to poor design. Factors which can affect performance include such parameters as the air input pressure, the air flow volume, air turbulence, air cleanliness and particulate content, temperature, humidity, work surface material, geometry and distance from the gun, local electrostatic fields, individual operator training and product age. In poorly designed devices, performance may also be adversely affected due to inefficient ion production, inefficient transport to the work surface and ion losses due to recombination and dispersion in the outside air. The present invention seeks to address the problems encountered with existing radioactive guns and in particular the present invention seeks to provide a radioactive gun which is substantially insensitive to changes in local conditions.

The present invention provides a surface static reduction device for generating a stream of ionized air comprising a cartridge having a chamber with an inlet for communication with a pressurised air supply and an outlet for the stream of ionized air, the chamber containing at least one radioactive source for ionizing air within chamber characterized in that the cartridge is arranged to produce an external stream of ionized air having a core region and a perimeter region with the average ion concentration in the core region being greater than the average ion concentration in the perimeter region.

A cylindrical static reduction device may be provided with a cylindrical radioactive source, the internal diameter of the cylindrical source being greater than 11 mm and less than 23 mm diameter and in which the input air pressure, the inlet diameter and the outlet diameter are matched to produce an internal air density and air velocity contour which causes the production rate of ionisation to be greater in the centre of the chamber than adjacent the walls of the chamber so that the stream of ionized air has an ion concentration in the core region of the air stream which is maximized and an ion concentration in the perimeter region of the air stream which is minimized. In addition the inlet diameter and the outlet diameter may be matched so that the internal air density inside the ionizing cartridge is substantially independent of pressure variation in the compressed air supply line.

Preferably, but not exclusively, the device is designed and operated so that the internal air density inside the cartridge is such that the maximum path length of alpha particles from the source is between about 0.55–0.85 (preferably 0.65–0.8, more preferably about 0.75) of the internal diameter of the source, (or if the source is planar, that fraction of the average height of the air space above the source). This produces an ion distribution in which the ion cloud from opposite sides of the cartridge overlap in the middle to produce a core region of higher (i.e. about double) ion concentration. The larger the cartridge diameter, the longer the alpha path length needs to be before there is overlap in the middle. The optimum air density is lower for large cartridge diameters.

Because of the need to balance ion concentration with air pressure in dependence on the diameter of the cartridge a practical limit arises for the useful range of internal diameters for such devices of between about 12–22 mm. The 12 mm devices need to be designed to operate at high internal pressure for optimum performance whereas the 22 mm diameter devices need to be designed to operate at low internal pressure for optimum performance.

In order to ensure the optimum internal operating pressure (i.e. air density) is achieved for any given cartridge diameter more usually in the range 12–22 mm the ratio of the internal diameter of the radioactive source to the output nozzle diameter is important. In a preferred embodiment, optimum performance is achieved when this ratio is in the range 2.5–4.5, preferably 3–4, more preferably 3.5.

In a second preferred embodiment the inlet nozzle diameter and the outlet nozzle diameter are matched so that the inlet nozzle has an air flow resistance which is greater than the air flow resistance of the output nozzle. The air inlet nozzle acts as the primary barrier to air flow through the device. When the velocity at the inlet is close to supersonic (as it usually is in practical conditions of use) the air input is said to be "choked". This causes the internal air density of the cartridge to be substantially independent of the air input pressure of the high pressure feed line. In other words, changing the input pressure does not substantially alter the air flow through the input nozzle. This enables the device to operate at optimum efficiency over a wide range of possible input pressures. This is achieved and optimized with the current invention when the ratio of the diameters of the output nozzle to the input nozzle is in the range 1.2–1.4, preferably 1.3. A representative set of workable design parameters for practical devices is summarized in the table below.

| Source Internal Diameter (SD) ~12–22 mm | Output Nozzle Diameter (OND) SD / OND ~3.5 | Input Nozzle Diameter (IND) OND / IND ~1.3 |
|---|---|---|
| 22 mm | 6–7 mm | 4.5–5.5 mm |
| 18 mm | 5–6 mm | 3.7–4.5 mm |
| 15 mm | 4–5 mm | 3.1–3.7 mm |
| 12 mm | 3–5 mm | 2.5–3.0 mm |

Local air velocity and velocity gradients inside the cartridge are important in determining where the local build up of ionization occurs, and how efficiently the ions produced are expelled from the device. Ion concentration is a function of both the ion production rate (due to source activity, location and ion overlap) and the local air flow volume per unit time at the point in question. Where the air velocity is high, the instantaneous ion concentration is low and vice versa due to the local rate of mixing. It is preferable to ensure that the air velocity in the perimeter region (i.e. adjacent to the source) is maximized so that the ion concentration in this region is low.

All static reduction devices lose ions due to recombination. This can occur inside a device due to collisions with internal surfaces or due to annihilation by collisions with oppositely charged ions. The amount of recombination is a complex function which depends on ion concentration, air flow velocity and turbulence and proximity to internal surfaces and on the total surface area available for recombination. In addition to this ions are lost outside the device due to dispersion and mixing with the outside air.

With the present invention, ion recombination losses are reduced due to the inclusion of novel design features which maximize the air flow velocity in the perimeter region of the cartridge. This substantially reduces the time for ion collisions and recombination to occur on the internal cartridge walls.

In a preferred embodiment an air inlet adapter is fitted to, or is integral with the inlet nozzle to improve the performance which prevents high velocity air from travelling straight along the central axis of the cartridge. The adapter deflects the air away from the central axis and towards the perimeter region where the velocity is then maximized.

In an alternative preferred embodiment, an inlet nozzle and air inlet adapter are, in practice, combined as a unitary item to provide both high air resistance compared with the output nozzle and also to deflect air from the central axis of the cartridge.

In an alternative preferred embodiment the at least one radioactive source is mounted so that it is substantially concentric with the chamber and divides the chamber into two air paths an inner ionizing air path and an outer path.

Thus, the surface static reduction device may be in the form of two concentric tubes open at both ends into which air is input at one end and in which the device contains a radioactive source inside the inner concentric tube which ionizes the air as it passes through the inner tube whereby air passing through both the inner tube and the outer tube recombines to form a single air stream which passes out of the device to form a stream of ionized air in which ions are predominantly located in the central core of the air stream. Alternatively the inner concentric tube may be replaced by a source and holder; the holder connects the source to the cartridge wall on support mountings (e.g. legs) so that air can pass in front of and behind the source without the need for a separate inner cartridge body to be located inside the chamber.

Figure 2A:
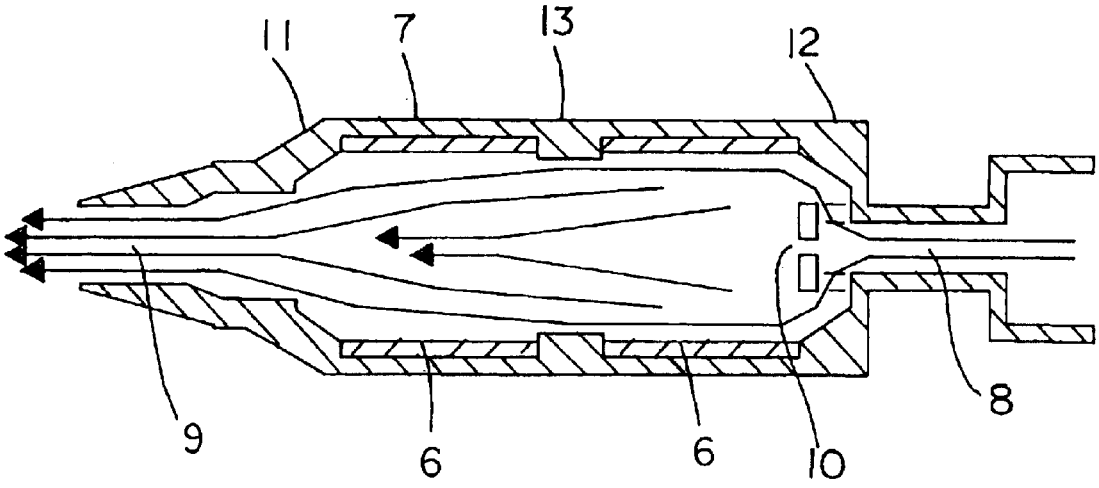
Figure 2B:
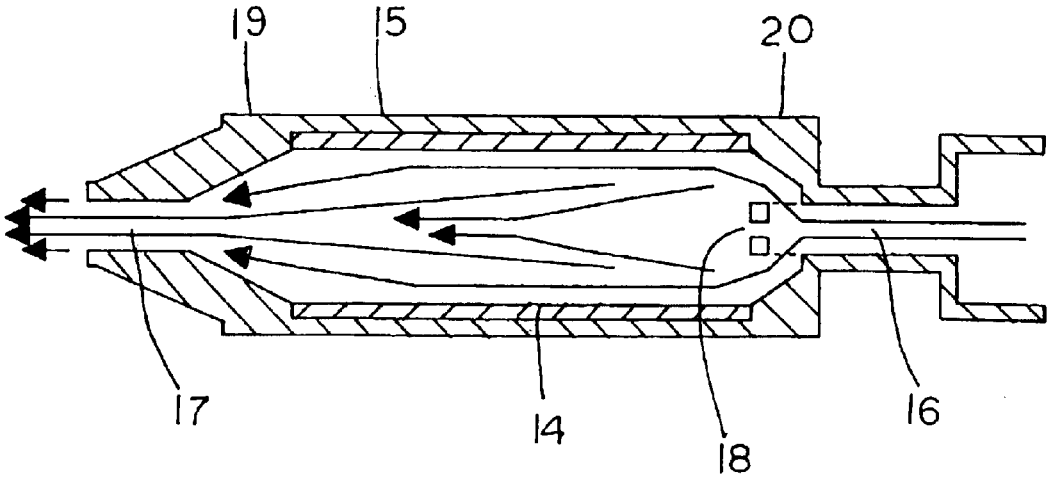
Figure 3:
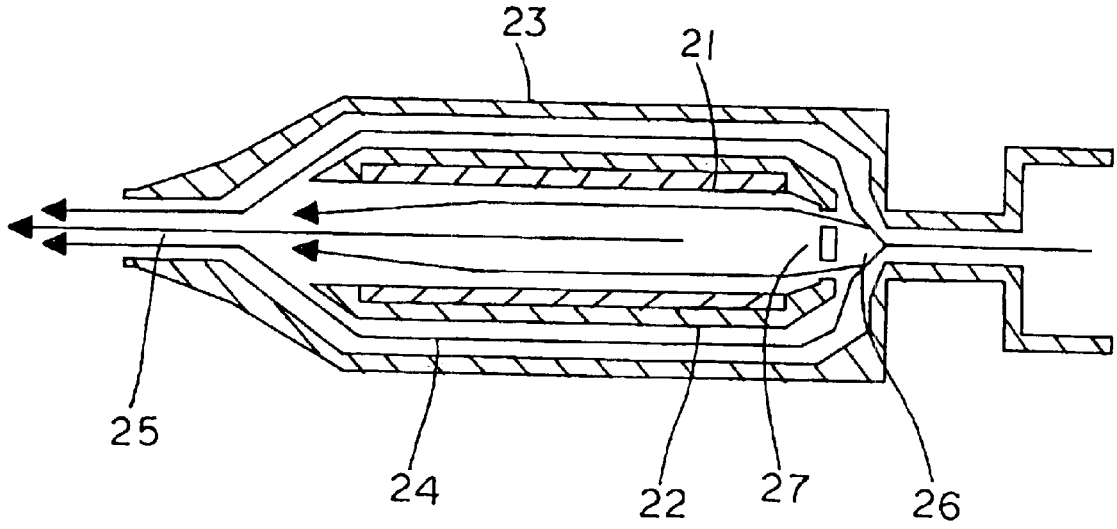
Figure 4B:
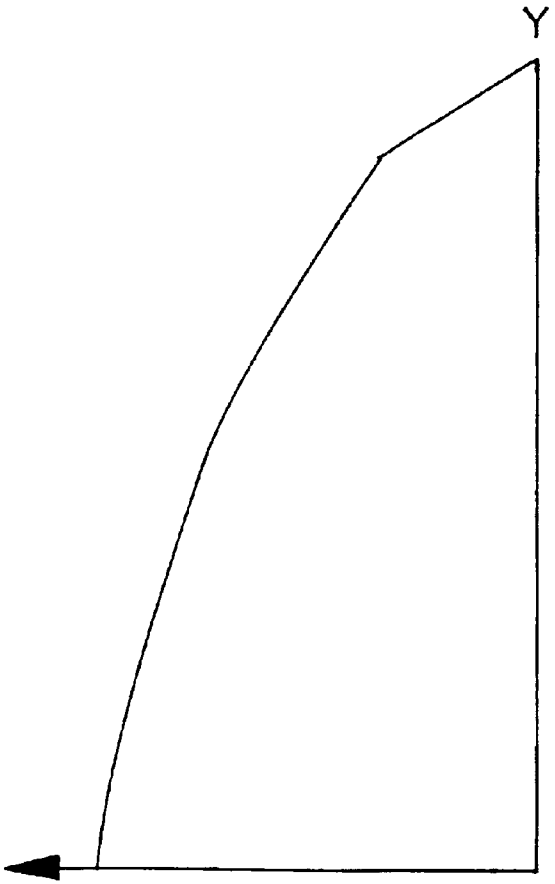
Figure 4A:
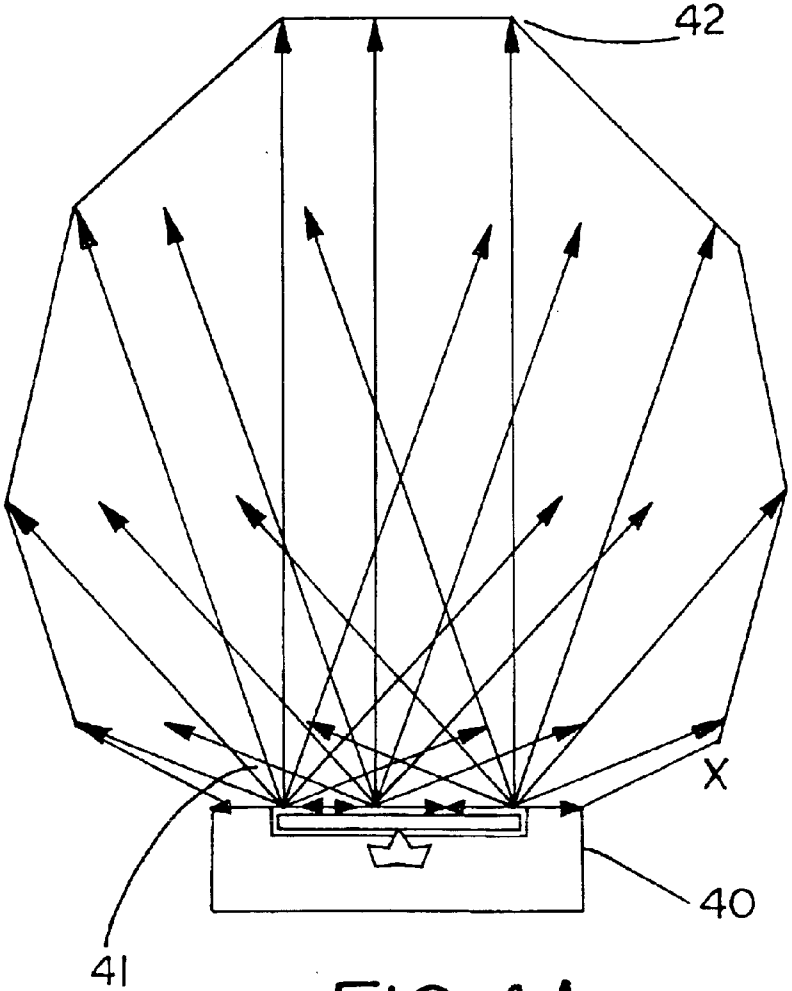
Figure 6A:
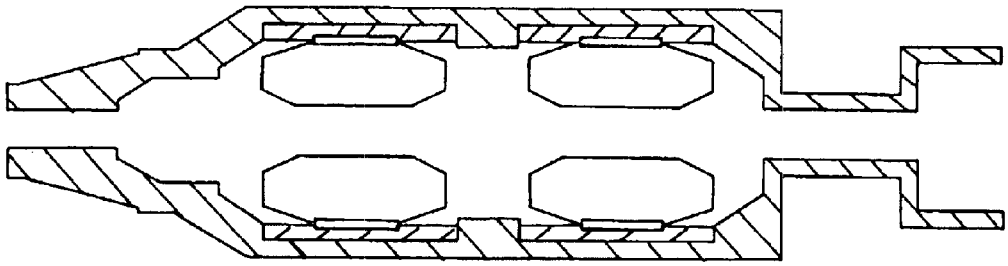
Figure 6B:
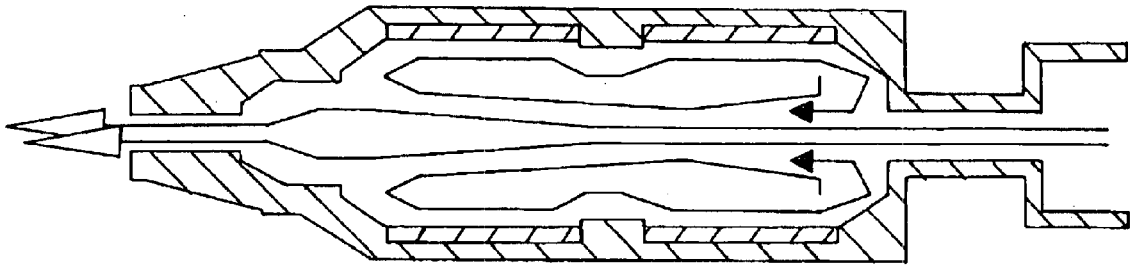
Figure 6C:
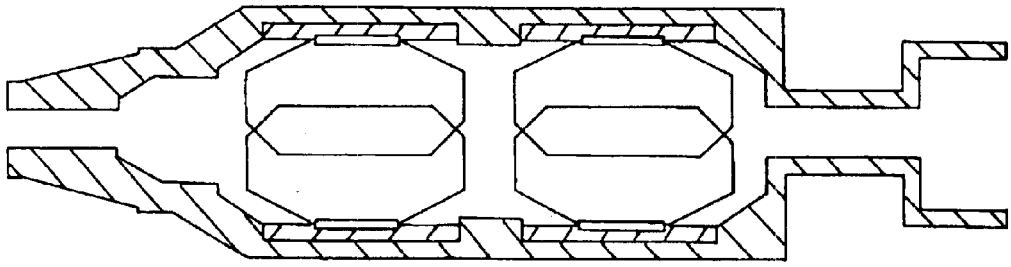
Figure 7:
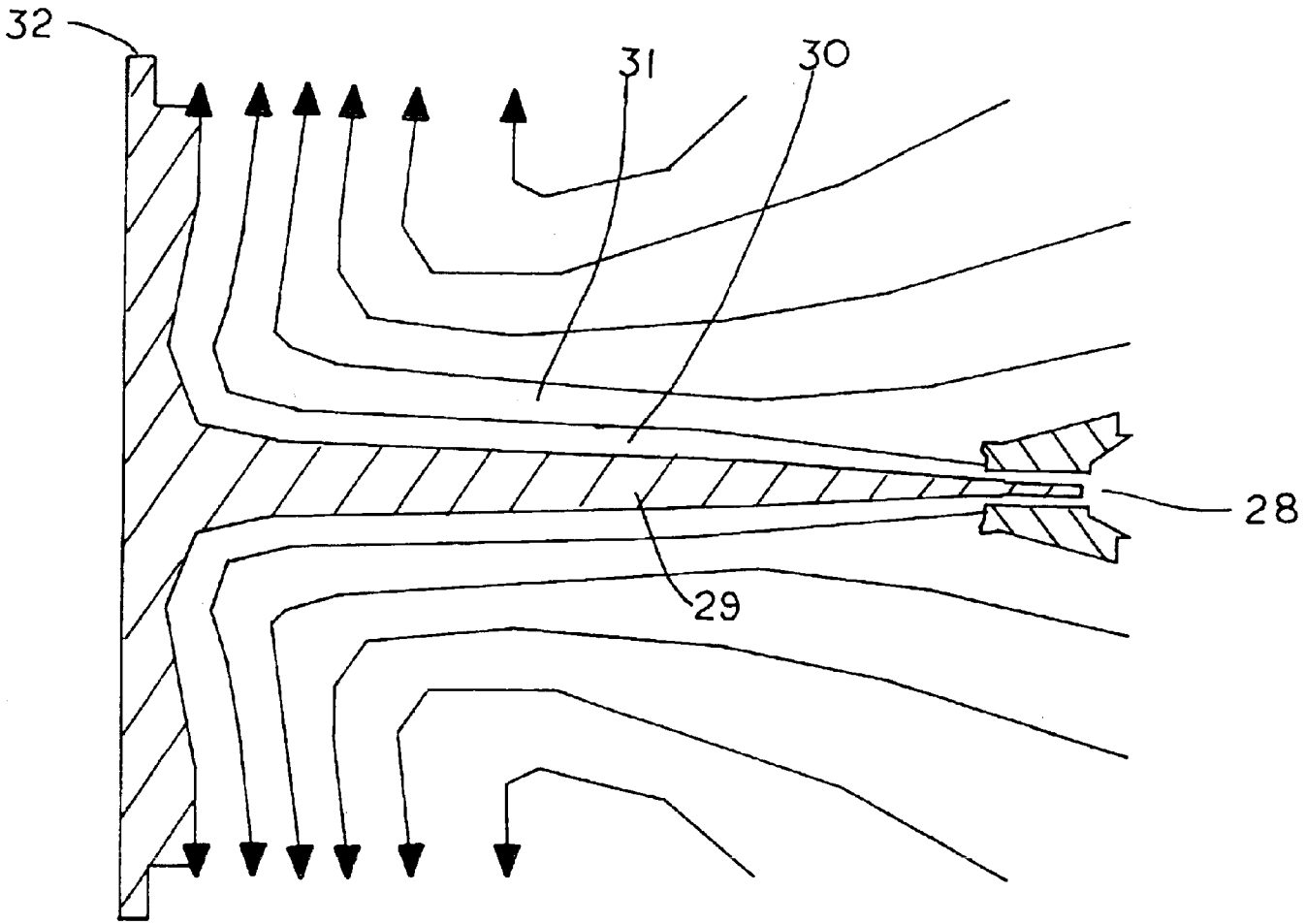
Figure 8B:
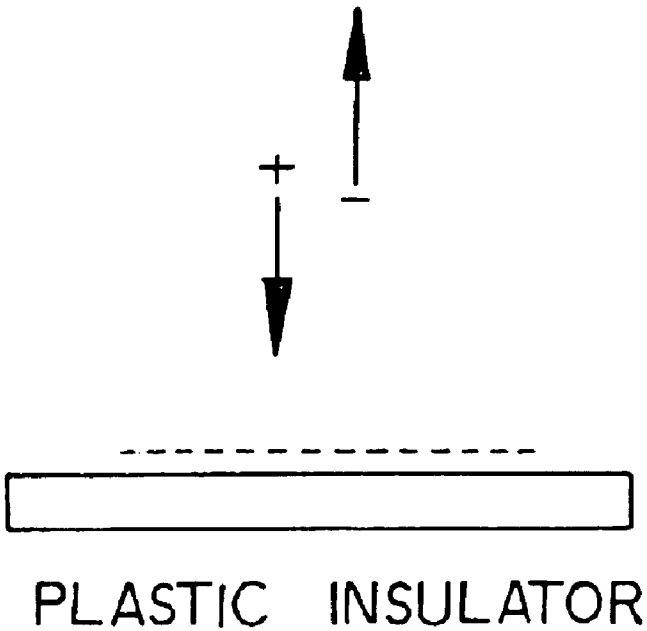
Figure 8A:
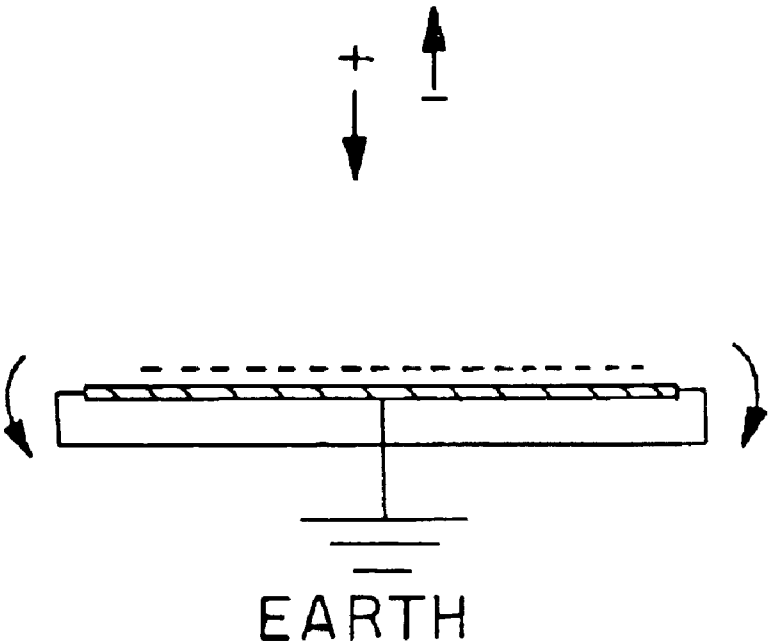

Embodiments of the present invention will now be described by way of example with reference to the accompanying drawings, in which:

FIG. 1 is a schematic diagram of a conventional radioactive gun;

FIGS. 2*a* and 2*b* are schematic diagrams of first and second embodiments of radioactive guns in accordance with the present invention;

FIG. 3 is a schematic diagram of a third embodiment of a radioactive gun in accordance with the present invention;

FIGS. 4*a* and 4*b* are schematic diagrams showing alpha emission from a radioactive foil;

FIGS. 5*a*, 5*b*, 5*c* and 5*d* are graphs of the ionization field within a radioactive gun under different operating conditions;

FIGS. 6*a*, 6*b* and 6*c* are schematic diagrams of computed air flow and ionization clouds within an ionizing cartridge;

FIG. 7 is a schematic diagram of the expected air flow outside of a radioactive gun or cartridge in the vicinity of a work surface; and FIGS. 8*a* and 8*b* are schematic diagrams showing electric field effects on conducting and insulating work surfaces respectively.

FIG. 2*a* is a schematic diagram of a preferred embodiment in which at least one radioactive source 6, two are shown in FIG. 2*a*, is mounted on the internal wall of the cartridge 7 so that the alpha particles from the source 6 are emitted in a direction predominantly towards the center of the chamber. The ratio of the internal diameter of the source 6 to the internal diameter of the output nozzle 9 is set to be in the range 2.5 to 4.5, preferably it is set to be in the range 3 to 4, more preferably 3.5. The ratio of the output nozzle diameter 9 to the input nozzle diameter 8 is set to be 1.2–1.4, preferably 1.3. Hence, with an internal cartridge diameter of 22 mm, the output nozzle diameter 9 of 6.5 mm is chosen and the inlet nozzle diameter 8 of 5 mm is chosen (or nozzle sizes with the same effective air resistance where the nozzles are not circular). Optionally, an air inlet adapter 10 is connected to or integrally formed as part of the air inlet nozzle 8 such that incoming air is substantially deflected away from the central axis of the cartridge towards the perimeter region to maximize the air flow volume and velocity in the perimeter region. This may be designed and shaped with features which affect and optimize the internal air flow and turbulence in the cartridge. The adapter may contain one or more holes, slots or other features (not shown) to guide and optimize air flow. The ends of the cartridge chamber 11 and 12 are internally angled to reduce turbulence and the internal length of the cartridge chamber between ends 11 and 12 is determined in dependence on the width of the sources 6 and the source fixing means 13. For example, the overall length may be 48 mm, but this length is not a critical feature except that reducing the overall internal surface area is desirable. Optionally, either one of the two sources 6 may be removed. Also, the output nozzle 9 is optionally provided with a small metal pin (not shown)

fitted across the diameter as a safety feature to prevent sharp objects being poked inside the cartridge from outside. Optionally, a handle with a trigger mechanism may be provided (not shown) on the inlet side of the cartridge as a means of controlling the input air pressure (such products are usually called static guns) or the device may be plumbed directly into a high pressure air line (these are usually called static cartridges).

FIG. 2*b* is a schematic diagram of a second alternative preferred embodiment in which at least one radioactive source 14 is mounted along the internal wall of the cartridge 15 generally in the shape of a "gutter" Preferably two such sources are located so as to face each other on opposite sides of the cartridge. As in FIG. 2*a,* the alpha particles from the sources 14 are emitted in a direction predominantly towards the center of the chamber. The ratio of the internal diameter of the source 14 to the internal diameter of the output nozzle 17 is set to be in the range 2.5 to 4.5, preferably it is set to be in the range 3 to 4, more preferably 3.5. The ratio of the output nozzle diameter 17 to the input nozzle diameter 16 is set to be 1.2–1.4, preferably 1.3. Where the internal cartridge diameter is 14 mm, an output nozzle diameter 17 of 4 mm is chosen (or nozzle sizes with the same effective air resistance if they are not circular) and an inlet nozzle diameter 16 of 3 mm is chosen. Optionally, an air inlet adapter 18 is connected to or, in practice, combined as part of the air inlet nozzle 16 such that incoming air is substantially deflected away from the central axis of the cartridge towards the perimeter region to maximize the air flow volume and velocity in the perimeter region. This may be designed and shaped with features which affect and optimize the internal air flow and turbulence in the cartridge. The adapter may contain one or more holes, slots or other features (not shown) to guide and optimize the air flow. The ends of the cartridge chamber 19 and 20 are internally angled to reduce turbulence and the internal length of the cartridge chamber between ends 19 and 20 is determined in dependence on the length of the sources 14. For example the internal length may be 30–60 mm, but this length is not a critical feature except that reducing the overall internal surface area is desirable. Optionally, either one of the two sources 14 may be removed. The output nozzle 17 is optionally provided with a small metal pin fitted across the diameter as a safety feature to prevent sharp objects being poked inside the cartridge from outside. Optionally, a handle with a trigger mechanism may be provided (not shown) on the inlet side of the cartridge as a means of controlling the input air pressure or the device may be plumbed directly into a high pressure air.

FIG. 3 is a schematic diagram of a third alternative embodiment in which at least one radioactive source 21 is mounted onto a substantially cylindrical holder 22. The radioactive source 21 may be generally in the shape of a "gutter". The holder 22 is mounted coaxially and concentric with the inner walls of the cartridge 23. The holder 22 may consist of or include at least some of the components of the device shown in FIG. 2*b* as a means of holding and mounting the source 21. The holder 22 (referred to as an inner chamber or inner cartridge) is attached by means of support legs 24 to the wall of the cartridge 23 so that two separate air paths are created; one along the central axis of the chamber and one between the inner chamber and the cartridge walls or outer chamber. As in FIGS. 2*a* and 2*b,* the alpha particles from the sources 21 are emitted in a direction predominantly towards the center of the inner chamber. The ratio of the internal diameter of the sources 21 to the internal diameter of the output nozzle 25 is set to be in the range 2.5 to 4.5, preferably it is set to be in the range 3 to 4, more preferably 3.5. The ratio of the output nozzle diameter 25 to the input nozzle diameter 26 is set to be 1.2–1.4, preferably 1.3. With an internal source diameter of 14 mm, an output nozzle diameter 25 of 4 mm is selected (or nozzle sizes with the same effective air resistance if they are not circular) and an inlet nozzle diameter 26 of 3 mm is selected. Optionally, an air inlet adapter 27 may be connected to or combined as part of the air inlet nozzle 26 such that incoming air is substantially deflected away from the central axis of the cartridge towards the outer chamber. On the other hand, as shown in FIG. 3 the inlet adapter 27 can be joined to or form part of one end of the inner chamber 22 so as to provide additional support to the inner chamber. The inlet adapter 27 is designed to achieve the optimum air volume and velocity in both the inner chamber and the outer chamber. Air from inner and outer regions of the device recombines in the region of the outlet nozzle 25 to form an air stream which is substantially devoid of ions in the perimeter region and substantially rich in ions in the core region. The length of the inner chamber may be 30–60 mm, but this length is not a critical feature except that reducing the overall internal surface area is desirable. The output nozzle 25 is optionally provided with a small metal pin fitted across the diameter as a safety feature to prevent sharp objects being poked inside the cartridge from outside. Optionally, a handle with a trigger mechanism may be provided on the inlet side of the cartridge as a means of controlling the input air pressure or the device may be plumbed directly into a high pressure air line.

The performance of a radioactive gun, of the type described above, having matched cartridge, outlet nozzle and inlet nozzle diameters of 22 mm, 6.5 mm, and 5 mm respectively was compared with a conventional commercially available radioactive gun having a 22 mm cartridge, a 3.5 mm outlet nozzle and a 5 mm inlet nozzle and another commercially available gun having an ~8 mm cartridge, a 5 mm inlet nozzle and a 5 mm outlet nozzle. Static dissipation times were measured in a standard work geometry and the 6.5 mm diameter nozzle was shown to have half the static dissipation time compared with either of the two commercial devices. This means the 6.5 mm diameter nozzle is capable of being twice as effective at transporting ions to the work surface.

When an inlet nozzle adapter as described previously was also added to the gun having a 22 mm cartridge, a 6.5 mm output nozzle and 5 mm inlet nozzle, static dissipation times were further reduced by an additional 15–30%. When one radioactive source adjacent to the inlet end of this device was removed the static dissipation time did not double as expected, but only increased by about 40%. This represented an improved performance of about 20% per unit activity. This improvement was not observed when the other source was removed. This indicates that the ionization from the source which is furthest from the inlet nozzle is more efficiently transported to the work surface.

It is known that expansion of a compressible fluid at a narrow constriction is accompanied by cooling of the fluid. Such a cooling effect is experienced at the down-wind side of a narrow constriction such as the inlet or the outlet nozzle of radioactive guns where there may be a rapid pressure drop. Even with small pressure differences the cooling effect can be significant and is sufficient for condensation outside the chamber to present a problem if the air humidity is high. It is well known that condensation preferentially forms on ions and so this cooling effect can become a major cause of ion loss. Moreover, it is also inadvisable to blow cold air over a work surface because this may cause condensation on the surface which is particularly undesirable in paint spraying applications. The effect of condensation can be reduced where the air humidity is kept low or if the air supply is pre-heated or the natural heating of the air supply compressor is retained by supplying the air through a thermally insulated feed line.

However, it will be appreciated that with the embodiments of FIGS. 2*a,* 2*b* and 3 the pressure change at the outlet nozzle is reduced compared with conventional guns and cartridges and so the designs shown in these figures provide the additional advantage of at least in part addressing condensation problems. It is usual in the industry for dry compressed air to be used in static gun applications to reduce the risk of condensation.

The embodiments of radioactive guns described above enable ion losses to be minimized and enable the number of ions which can reach the work surface to be maximised. With the embodiments described a stream of ionized air is produced in which the majority of ions are concentrated in the middle of the air stream whilst the outer region of the air stream is substantially devoid of ions. Thus, when turbulent mixing at the edge of the air stream causes entrainment of the outside air, dilution and broadening of the air stream there are minimal ion losses. Moreover, these embodiments have been shown experimentally to provide a significant performance improvement compared with previously known designs.

The following is a discussion of the parameters affecting the performance and thus the efficiency of radioactive guns and provides some insight into the advantages afforded by the embodiments of radioactive guns described above.

$^{210}$Po, which is the preferred radioisotope employed in static eliminator guns, emits alpha particles with an energy of 5.3 MeV. The particles are emitted in all directions and at least half of them are emitted back into the foil and are lost. Those that travel forwards pass through a thin protective metal face which acts as a protective seal to prevent radioactive material from escaping into the cartridge. FIGS. 4*a* and 4*b* show schematic diagrams of alpha emission from a foil 40.

The alpha particles lose some of their energy on their way through the metal face 41. The amount of energy they lose depends on the face thickness, the face material and the angle of emission. The thickness and material used for the protective face varies according to the design preferences of individual manufacturers. Gold, silver, palladium and copper or alloys of these have all been used. Face thicknesses can vary from typically 1 $\mu$m to 3 $\mu$m. On average only just over half the original 5.3 MeV energy is retained by those alpha particles which are emitted (and only about 40% are emitted forwards through the face). The total ionizing energy available for use is therefore only about a quarter of the total decay energy from $^{210}$Po inside the foil.

Emitted alpha particles interact with the air and lose their remaining energy in a series of collisions in which about 35 eV of energy is lost per collision. This means that the particles undergo many tens of thousands of collisions before they come to rest, causing ionization along the way. The process produces equal numbers of both positive and negative ions (not counting the original alpha particles). The ions which are created are positively and negatively charged air molecules and atoms and free electrons. FIG. 4*b* shows graphically the amount of ionization (X) with respect to the distance (Y) from the foil.

The total distance the ionizations field 42 extends away from the foil surface depends on the air density. For example, the maximum range of alpha particles is around 12 mm at one atmosphere. The ionization is proportional to the pressure in the cartridge providing there are no significant local temperature gradients. (It should be noted however that in a real cartridge, there can be significant local temperature gradients, so local pressure and local density may not be proportional). Doubling the air pressure roughly halves the size of the ionization field. Three times the pressure reduces it to about a third. But as this occurs the ionization density also increases. The total amount of ionization actually increases slightly with increasing pressure. This is about 20–30% higher at 16 psi above atmospheric pressure compared with 3.5 psi above atmospheric pressure, but the ionization field is then located in close proximity to the foil surface where recombination on surfaces can occur.

The air pressure inside a chamber can be changed by altering the input air pressure, changing the dimensions of the input and output nozzles and the cartridge diameter. Pressure also depends on whether the air flow is laminar or turbulent and on the local temperature and air velocity.

The relative ionization density (Y) as a function of distance (X) in centimetres from the central axis of a 22 mm diameter cartridge was computed at various pressures (assuming an ambient temperature of 298K) and the results are plotted in the four graphs shown in FIGS. 5*a–d.* The parameters of the cartridge used in these calculations were:

| | |
|---|---|
| radioactive source | 10 mCi, $^{210}$Po annular foil |
| face material | copper |
| face thickness | 3 $\mu$m |
| internal cartridge diameter | 22 mm |
| input air pressure | 50 psi |
| inlet nozzle diameter | 5 mm |

Figure 5A:
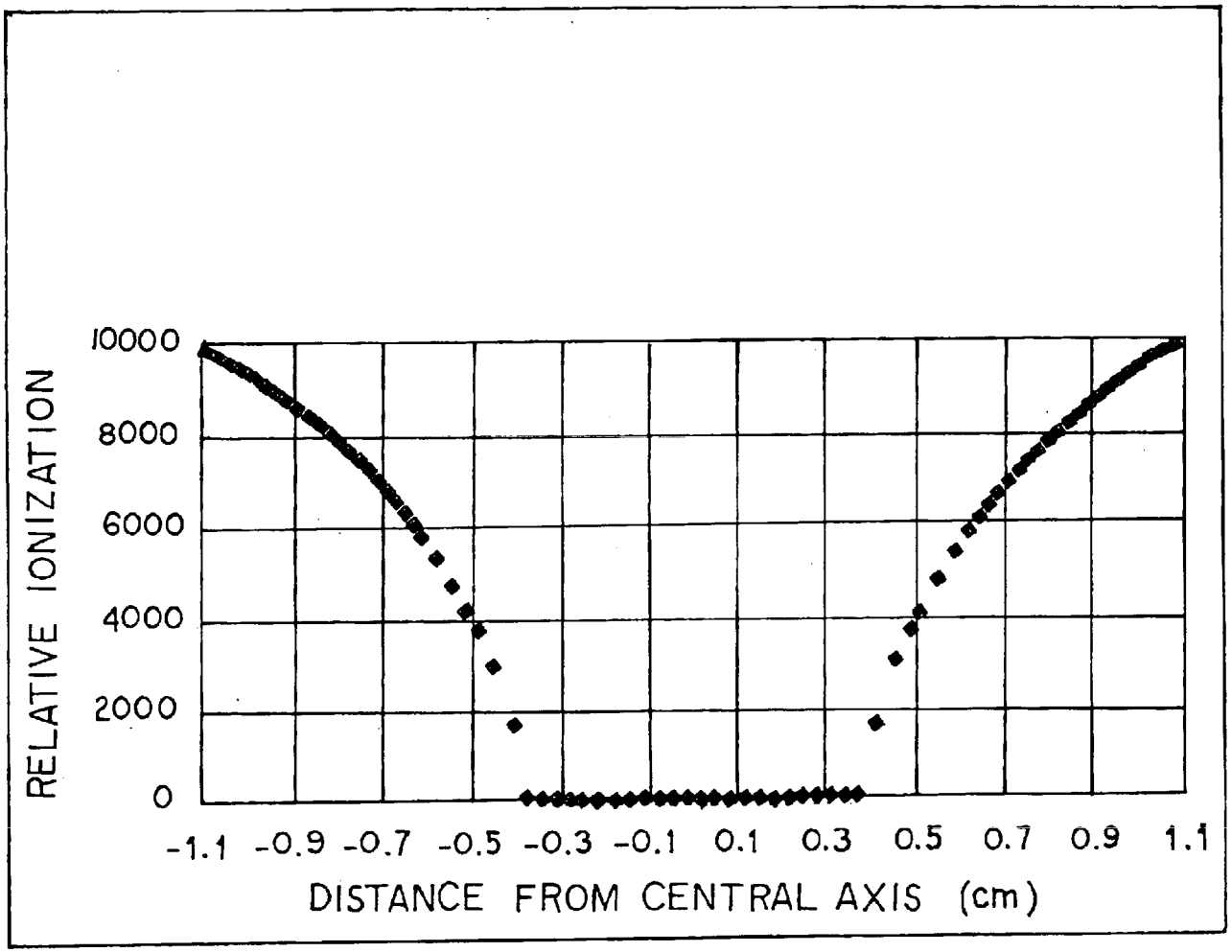
Figure 5B:
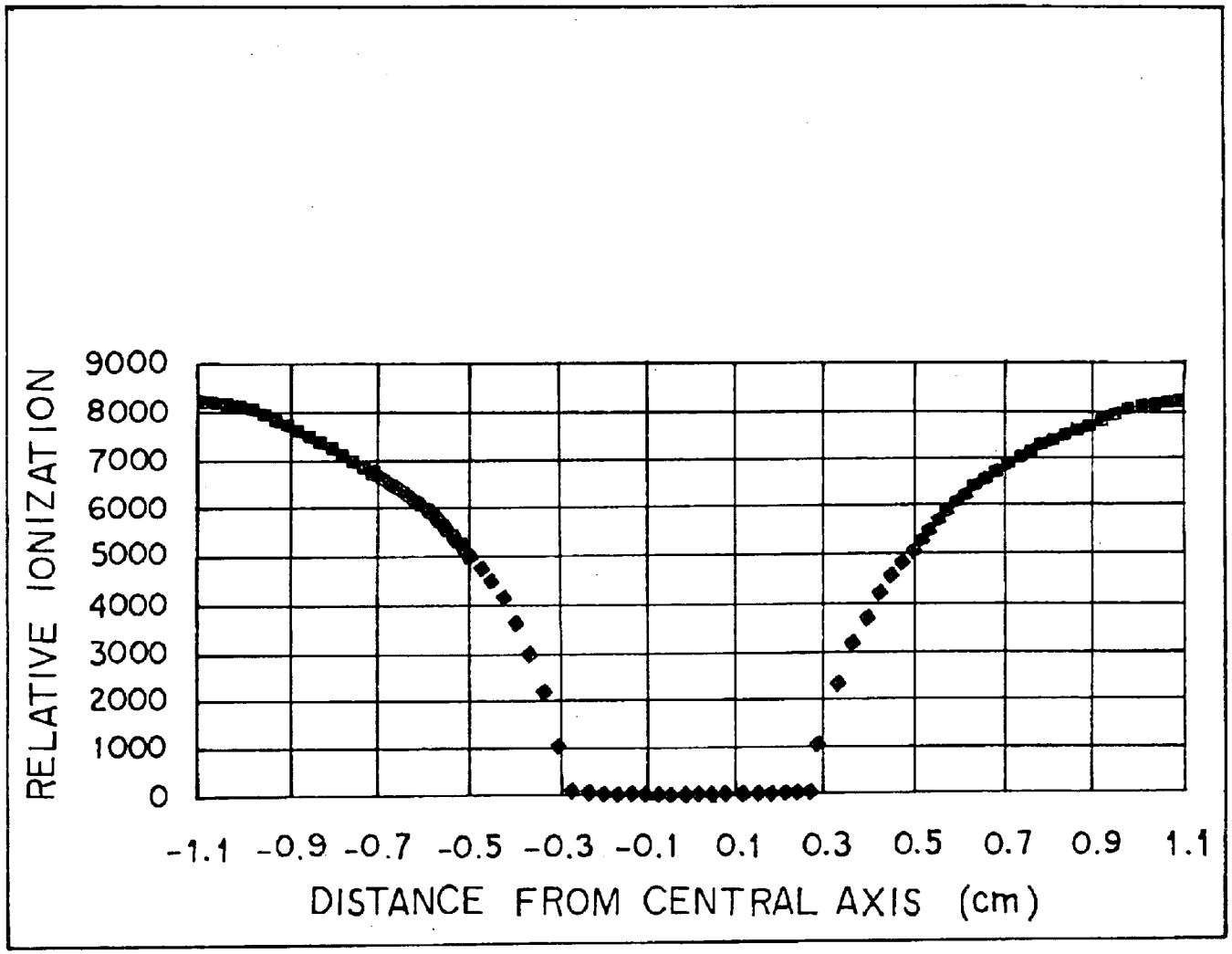
Figure 5C:
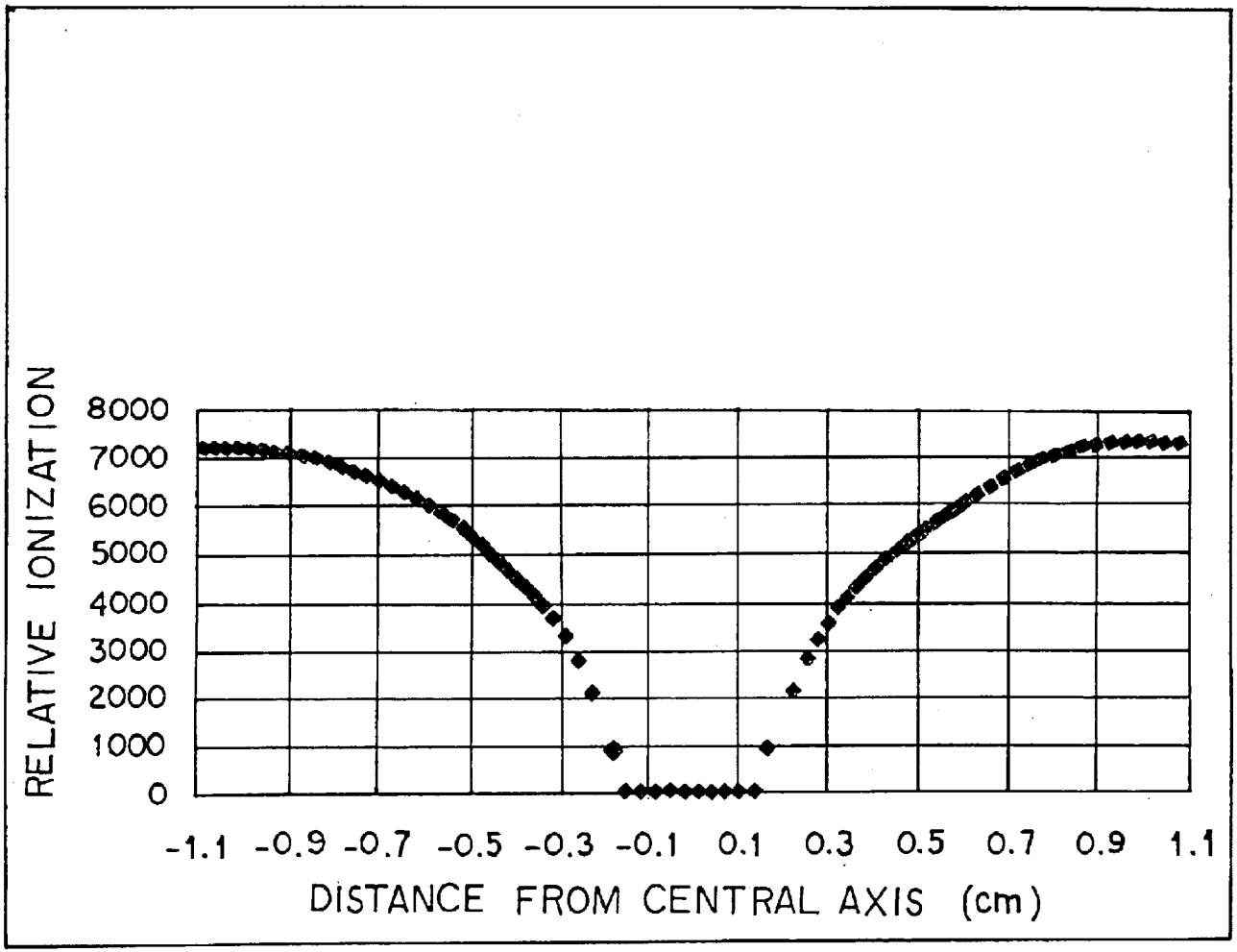
Figure 5D:
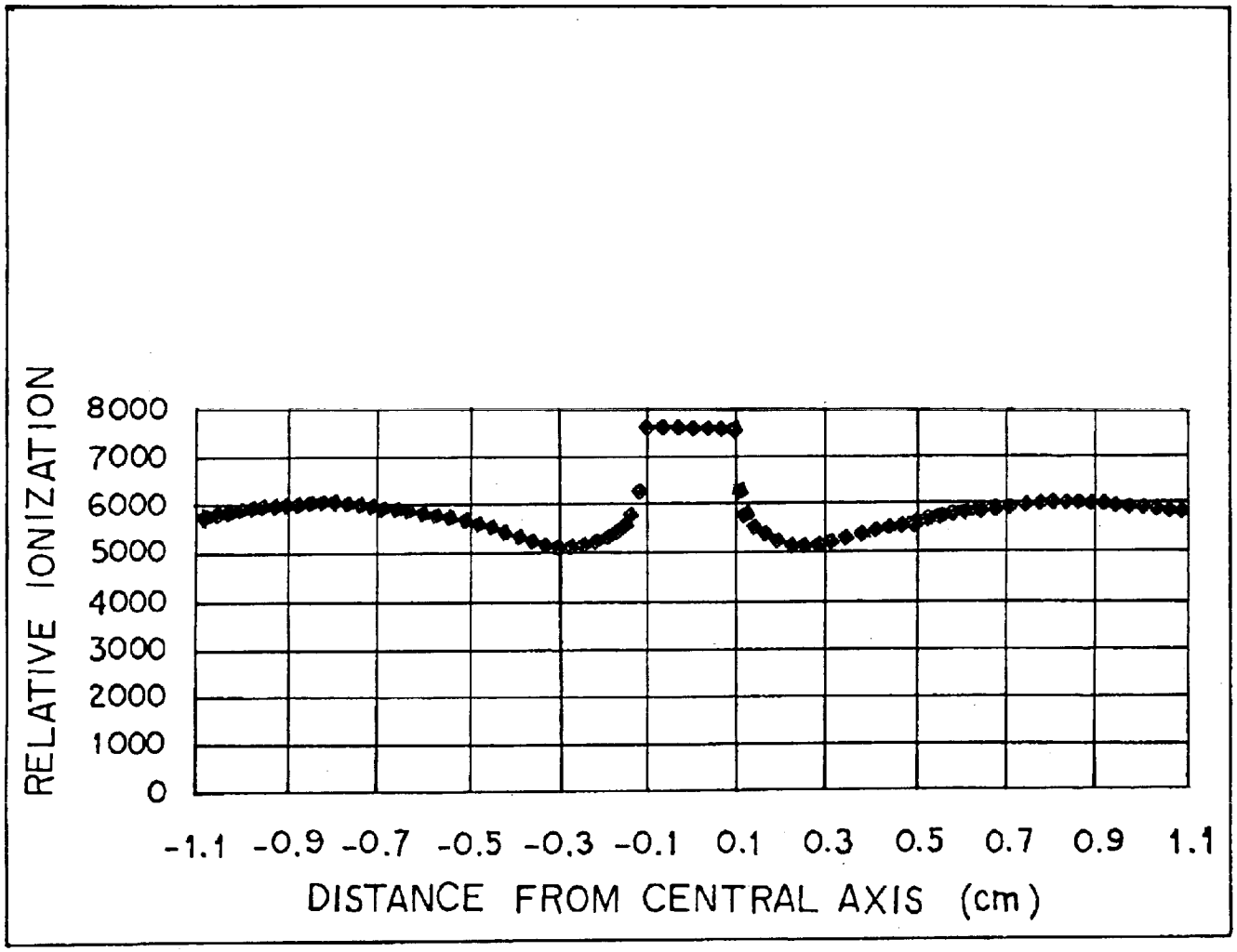

| | FIG. 5a | FIG. 5b | FIG. 5c | FIG. 5d |
|---|---|---|---|---|
| output nozzle diameters (mm) | 3.5 | 4.5 | 5.5 | 6.5 |
| internal air pressures (psi) | 16 | 11 | 8 | 3.5 |
| total ionisation per mCi | 22305 | 21673 | 21032 | 19355 |

The results show clearly the effect of internal air pressure on the density and position of the ionization field inside the cartridge of a radioactive gun. It can be seen from FIG. 5*a* that when the pressure is 16 psi above atmospheric pressure and the output nozzle diameter is 3.5 mm there is no ionization in the central part of the chamber. In fact the middle 8 mm is completely empty and less than 20% of the ions are in the middle half (i.e. middle 11 mm) of the chamber. All of the ions are within 7 mm of the face of the foil.

The internal pressure inside the cartridge drops when the output nozzle diameter is increased. In this set of examples the input pressure was kept at 50 psi which is typical for the industry. When the output nozzle diameter was increased from 3.5 mm to 4.5 mm, 5.5 mm and 6.5 mm the internal pressure (measured experimentally) reduced to 11 psi, 8 psi and 3.5 psi respectively. FIGS. 5*a*–5*d* show that the computed ionization field progressively extended further away from the foil towards the center of the cartridge until in FIG. 5*d* the ionization overlapped at the center. This gave rise to a region in the center where the ion concentration was higher than anywhere else.

How the particles are transported out of the cartridge towards the work surface is also an important factor in the efficiency of the gun. Air flow can be laminar or turbulent or it can be partly both. A typical air flow volume through a cartridge when it is in use is around 5–10 cubic feet per minute. This gives a typical air velocity of about 300 m/s in the center of a 5 mm diameter inlet nozzle which is close to supersonic. The input nozzle serves to "choke" the input air supply because increasing the input pressure attempts to raise the velocity closer to supersonic speed which produces much greater turbulence and air resistance. Therefore, when input pressures which are typical for the industry are used and when the input nozzle diameter is appropriately matched to the outlet nozzle diameter as described above the internal air pressure in the cartridge can be substantially independent of the feed line pressure. If the inlet diameter is larger than the outlet diameter, the air flow becomes "choked" at the outlet and the internal chamber pressure will rise and fall in relation to the feed line pressure. The performance of such a device would therefore be variable in dependence on the feed line pressure, since this directly affects the ion distribution in the cartridge it is undesirable. The designs of ionization devices described above overcome this problem by matching the inlet and outlet nozzles so that the outlet nozzle is always larger than the inlet nozzle.

FIGS. 6*a*–6*c* are schematic diagrams of the computed air flow and ionization could from a 22 mm diameter ionizing cartridge which is operating at high (FIG. 6*a*) and low (FIG. 6*c*) internal chamber pressure. In this example the internal pressure would be high in the case of a 3.5 mm output nozzle or low in the case of a 6.5 mm outlet nozzle. The ionization clouds are represented in FIGS. 6*a* and 6*c* as the shaded areas. It can be seen that no ions are produced in the core of the air stream for high pressure conditions whereas there is ion overlap for low pressure conditions.

The air flow at both high and low pressure is represented schematically in FIG. 6*b*. Computed air flow data was obtained using computational fluid dynamics software. It can be seen from FIG. 6*b* that there is an area of recirculation in proximity to the surface of the sources in which air circles or spirals around several times before it becomes entrained into the central core of the air stream which flows down the middle of the chamber. The air velocity in proximity to the surface of the source was computed to be approximately 20–30 m/s (in the reverse direction) in the low pressure design and approximately 10–15 m/s (in the reverse direction) in the high pressure design compared with approximately 150–250 m/s (in the forward direction) along the central axis.

By comparing FIG. 6*a* with FIG. 6*b* it is clear that in the high pressure design the region of greatest ion production occurs in the center of the recirculation zone and no ions are produced in the core air flow. In the low pressure case the region of greatest ion production occurs in the central core of the air flow. The results of computational modeling of the ion distribution and of the air flows are consistent with the observed performance improvement of the low pressure design using the 22 mm diameter cartridge.

As discussed previously the low pressure design can be improved further by adding an inlet adapter to direct air away from the central axis of the cartridge. The resultant air flow is then typically as shown in FIG. 2. As previously described, this can improve the performance by a further 30%.

In normal use an ionizing cartridge is held about 25–50 cm from a surface to be discharged. The output nozzle is pointed more or less perpendicular to the surface and the cartridge is swept from side to side to bathe the whole surface with ions and to blow dust away with the air stream. With the ionization devices described above the central core of the air stream contains most of the ions which is the part of the air stream transported most effectively to the work surface. In conventional designs the majority of the ions can be on the outside of the air stream and can be lost or may never reach the work surface.

The external air stream from a gun or cartridge of the preferred embodiment is represented in FIG. 7. The nature of the external air flow was computed using computational fluid dynamics software. FIG. 7 shows an output nozzle 28 from which is emerging high velocity air comprising a region 29 shaded in dark grey which is substantially rich in ionization, a perimeter region 30 which is substantially deficient in ions and external air 31 which is unshaded which is swept into and becomes entrained and mixed into the perimeter region of the air flow. The air stream is directed to a charged work surface 32 at which ionization is attracted to the surface and the charge on the surface is eliminated. It will be seen that only air in the core region comes into contact with, or in close proximity to the work surface. Air in the perimeter region mixes with the outside air which becomes entrained and causes the air stream to broaden and slow down in the perimeter region. Results of computational air flow modelling are consistent with the observed performance improvement when the ionization concentration in the core region of the air stream is maximized.

The surface of the work to be treated can be highly charged. This causes an electric field to exist between the ionizing cartridge and the work surface. The positive and negative ions in the air stream are attracted or repelled by this field depending on whether the surface is positively or negatively charged. The size of the field depends on the amount of charge on the work surface. It also depends on the surface construction and whether it is earthed. A charged, earthed, painted metal surface (FIG. 8*a*) acts like a capacitor with the negative charge on the painted surface causing an opposite charge to be drawn up from the earth onto the metal beneath. The surface has no net positive or negative charge and most of the field lines of force go between the front and back of the painted surface with few lines of force extending outwards towards the cartridge. At the painted surface though a lot of static charge and a very strong short-range attractive force is present holding polarized dust particles onto the surface whereas only a small electrostatic field force is felt by the ions above the surface. The field gradient felt by the ions may be only a few tens of volts in practice. The only way these ions can get to the surface to eliminate the charge is if they are blown there by the cartridge.

An insulating plastic surface (FIG. 8*b*) on the other hand has a high net charge and the electrostatic field is large. This can be many tens of thousands of volts in practice. In this case there is a strong attractive and repulsive force which draws ions towards or away from the surface. Thus with the insulating plastic surface the distribution of ions in the air stream is less important because ions which are in the perimeter region of the air stream can still be strongly attracted to the work surface.

Therefore, the embodiments described above are particularly suited to paint spraying applications where coated metal parts are to be painted although the radioactive guns can be employed in many other circumstances where surface static needs to be removed.

What is claimed is:

1. For connection to a pressurized air supply, a surface static reduction device for generating an outlet stream of ionized air comprising a cartridge having a chamber with an inlet and only a single outlet, the inlet adapted for connection to the pressurized air supply, the outlet shaped to form the outlet stream, the chamber containing therein a quantity of air, the chamber containing at least one radioactive source for ionizing the quantity of air within the chamber, the cartridge being arranged to produce in the outlet stream a core region and a perimeter region, the cartridge further being arranged such that an average ion concentration in the core region is greater than an average ion concentration in the perimeter region, and including a holder mounted within the chamber, the holder having an inner surface adapted to receive the radioactive source, the holder further being adapted to create an inner ionizing air path and an outer air path.

2. A surface static reduction device as claimed in claim 1, wherein a diameter of an internal surface of the radioactive source, a diameter of the outlet, and a diameter of an output portion of the inlet are sized to produce an internal operating density which is substantially independent of a pressure level of the air supply thereby causing ion overlap to occur in a center of the cartridge and whereby an ion production rate in the core region is substantially higher than an ion production rate in the perimeter region.

3. A surface static reduction device according to claim 1 in which a diameter of the outlet is larger than a diameter of the inlet so as to produce an operating condition in which an air density level inside the cartridge is substantially independent of a pressure level of the air supply.

4. A surface static reduction device according to claim 1 in which a ratio of a diameter of the outlet to a diameter of the inlet is in the range 1.2–1.4.

5. A surface static reduction device as claimed in claim 4 in which the ratio of the diameter of the outlet to the diameter of the inlet is approximately 1.3.

6. A surface static reduction device according to claim 2, wherein the radioactive source produces alpha particles and wherein an air density level is such that a maximum path length of the alpha particles from the radioactive source is between 0.55–0.85 of the diameter of the internal surface of the radioactive source.

7. A surface static reduction device as claimed in claim 6, in which an internal operating air density is such that the maximum path length of the alpha particles from the radioactive source is between 0.65–0.8 of the internal diameter of the source.

8. A surface static reduction device according to claim 1 in which a ratio of an internal diameter of the radioactive source to a diameter of the outlet is in the range 2.5–4.5.

9. A surface static reduction device as claimed in claim 8, in which the ratio of the internal diameter of the radioactive source to an output nozzle diameter is in the range of 3–4.

10. A surface static reduction device as claimed in claim 9, in which the ratio of the internal diameter of the radioactive source to the output nozzle diameter is 3.5.

11. A surface static reduction device according to claim 1 and including an adapter mounted adjacent the inlet, the adaptor including a deflector for deflecting at least a portion of an incoming air stream away from a central axis of the cartridge and towards the perimeter region to maximize an air flow volume and an air flow velocity in the perimeter region and to reduce air recirculation.

12. For use with a surface static reduction device for producing an outlet stream of ionized air from a source of pressurized air and a radioactive source, a cartridge comprising:

an inlet adapted for connection to the source of pressurized air to create an inlet stream;

an outlet for guiding the outlet stream;

an enclosed chamber disposed between the inlet and the outlet, the enclosed chamber having an interior adapted to receive the radioactive source to thereby permit ionization of the inlet stream within the chamber to thereby ionize the pressurized air, the chamber being shaped to create a core region and a perimeter region in the outlet stream, the core region having an average ion concentration greater than an average ion concentration of the perimeter region; and a holder mounted concentrically within the chamber, the holder having an inner surface adapted to receive the radioactive source, the holder further being adapted to create an inner air path flowing past the radioactive source and an outer air path, the inner air path and the outer air path converging to form the outlet stream.

* * * * *

UNITED STATES PATENT AND TRADEMARK OFFICE

CERTIFICATE OF CORRECTION

PATENT NO. : 6,739,530 B1
DATED : May 25, 2004
INVENTOR(S) : Mark G. Shilton et al.

It is certified that error appears in the above-identified patent and that said Letters Patent is hereby corrected as shown below:

Title page,
Item [57], ABSTRACT,
Line 7, delete "an is" and insert -- and is --.

Signed and Sealed this

Thirty-first Day of August, 2004

JON W. DUDAS
*Director of the United States Patent and Trademark Office*